US009828978B2

(12) United States Patent
Middleton et al.

(10) Patent No.: US 9,828,978 B2
(45) Date of Patent: Nov. 28, 2017

(54) FLUID PUMP HAVING LIQUID RESERVOIR AND MODIFIED PRESSURE RELIEF SLOT

(71) Applicant: Fluid Metering, Inc., Syosset, NY (US)

(72) Inventors: Joseph Ervin Middleton, Dix Hills, NY (US); David Lionel Rawlings, Sound Beach, NY (US)

(73) Assignee: FLUID METERING, INC., Syosset, NY (US)

( * ) Notice: Subject to any disclaimer, the term of this patent is extended or adjusted under 35 U.S.C. 154(b) by 0 days.

(21) Appl. No.: 14/990,949

(22) Filed: Jan. 8, 2016

(65) Prior Publication Data

US 2016/0123312 A1 May 5, 2016

Related U.S. Application Data

(62) Division of application No. 13/490,815, filed on Jun. 7, 2012, now Pat. No. 9,261,085.

(60) Provisional application No. 61/495,648, filed on Jun. 10, 2011.

(51) Int. Cl.

| | |
|---|---|
| ***F04B 7/04*** | (2006.01) |
| ***F04B 7/06*** | (2006.01) |
| ***F04B 13/00*** | (2006.01) |
| ***F04B 23/02*** | (2006.01) |
| ***F04B 53/14*** | (2006.01) |
| ***F04B 53/16*** | (2006.01) |

(52) U.S. Cl.

CPC ..... *F04B 7/06* (2013.01); *F04B 7/04* (2013.01); *F04B 13/00* (2013.01); *F04B 23/02* (2013.01); *F04B 53/14* (2013.01); *F04B 53/166* (2013.01)

(58) Field of Classification Search

CPC ..... F04B 7/04; F04B 7/06

USPC ..... 417/296, 500

See application file for complete search history.

(56) References Cited

U.S. PATENT DOCUMENTS

| | | | |
|---|---|---|---|
| 1,223,122 | A | 4/1917 | Subry |
| 2,276,225 | A | 3/1942 | Carter |
| 2,771,880 | A | 11/1956 | Gotthart |
| 2,970,021 | A | 1/1961 | Glaser et al. |
| 3,153,385 | A | 10/1964 | Bowen, Jr. |
| 3,511,512 | A | 5/1970 | Wheelock |
| 4,822,059 | A | 4/1989 | Shimasaki et al. |
| 4,941,809 | A | 7/1990 | Pinkerton |
| 5,015,157 | A | 5/1991 | Pinkerton et al. |
| 5,020,980 | A | 6/1991 | Pinkerton |
| 5,044,889 | A | 9/1991 | Pinkerton |
| 5,092,037 | A | 3/1992 | Pinkerton |
| 5,209,502 | A | 5/1993 | Savoia |
| 5,472,320 | A | 12/1995 | Weisbrodt |
| 5,601,421 | A | 2/1997 | Lee |
| 5,921,555 | A | 7/1999 | Johnston |

(Continued)

*Primary Examiner* — Peter J Bertheaud

(74) *Attorney, Agent, or Firm* — Hoffmann & Baron, LLP

(57) ABSTRACT

A pump, which generally includes a pump housing and a pump piston. The pump housing defines a central longitudinal bore, a transverse bore communicating with the central bore for conveying a liquid through the pump housing, a liquid reservoir communicating with the central bore and the transverse bore for retaining an amount of the liquid conveyed through the transverse bore and a pressure relief slot extending from the transverse bore to the liquid reservoir. The pump piston is axially and rotatably slidable within the central longitudinal bore for pumping the liquid through the transverse bore.

7 Claims, 6 Drawing Sheets

(56) References Cited

U.S. PATENT DOCUMENTS

| | | | | |
|---|---|---|---|---|
| 5,941,533 | A | 8/1999 | Jacobsen et al. | |
| 6,095,780 | A | 8/2000 | Ernens | |
| 6,409,175 | B1 | 6/2002 | Evans et al. | |
| 6,428,013 | B1 | 8/2002 | Johnston et al. | |
| 7,387,502 | B1 | 6/2008 | Rawlings et al. | |
| 7,785,084 | B1 * | 8/2010 | Rawlings | F04B 13/00 417/500 |
| 8,382,458 | B2 | 2/2013 | Hashida et al. | |
| 8,562,310 | B1 * | 10/2013 | Rawlings | F04B 13/00 417/360 |
| 9,261,085 | B2 * | 2/2016 | Middleton | F04B 13/00 |
| 2002/0176791 | A1 | 11/2002 | Uera | |
| 2004/0241023 | A1 | 12/2004 | Pinkerton et al. | |
| 2006/0169134 | A1 | 8/2006 | Dunaevsky et al. | |
| 2007/0256556 | A1 * | 11/2007 | Rawlings | F16J 15/3228 92/165 R |
| 2008/0019853 | A1 * | 1/2008 | Hashida | F02M 59/102 417/490 |

* cited by examiner

FLUID PUMP HAVING LIQUID RESERVOIR AND MODIFIED PRESSURE RELIEF SLOT

CROSS-REFERENCE TO RELATED APPLICATIONS

This application is a divisional application of U.S. application Ser. No. 13/490,815, filed Jun. 7, 2012, which claims the benefit of U.S. Provisional Application No. 61/495,648, filed on Jun. 10, 2011.

BACKGROUND OF THE INVENTION

The present invention relates generally to liquid pumping systems, wherein one liquid is pumped or fed into the stream of another liquid. More particularly, the present invention relates to a liquid pump with a liquid reservoir and modified pressure relief slot to minimize leaking.

There are situations in which it is necessary to inject or feed one liquid into the stream of another liquid. Some liquid pumping systems require an occasional injection of liquid while others need a more continuous feed of the liquid. Still others might require a combination of the two. For purposes of this disclosure, it is understood that the term "feed" will include inject.

One such common application is in the field of water treatment wherein certain chemicals, such as chlorinating solutions, fluorination chemicals and other liquids, are fed into the water stream at a point prior to its delivery for end use by consumers. It is important to maintain certain percentage levels of these added liquids in order to assure adequate functionality without exceeding predetermined concentrations which could be objectionable or even harmful to the consumer.

A variety of apparatus is available in the industry to perform this chemical feed task. Such apparatus typically takes the form of a pump, wherein pump speed and chemical feed rate is controlled by well known electronic means which employs chemical concentration detection means and provides voltage or current signal output for use by the pump drive system to adjust its feed rate. This system operates in a closed loop fashion to maintain a relatively stable concentration of the desired chemical in the water stream.

Pumps used to inject chlorinating solutions, such as Sodium Hypochlorite (NaOCl), into a pressurized water stream frequently encounter problems associated with crystallization of the NaOCl. Although crystallization, with its tendency to lock parts, has been previously considered in various pump designs, the abrasive nature of these crystals was not thoroughly considered.

Positive displacement pumps having a ceramic piston and a liner are often plagued with consequential problems arising from such abrasive crystals. During normal pump operation, the piston will rotate and reciprocate in and out of the pump head. Upon outward movement of the piston, suitably designed sealing elements will wipe the piston surface to minimize dragging of any pumped liquid out of the pump head. This squeegee action of the seals is not, however, perfect. Some liquid is always present as a film on the exposed piston surface.

This primary difficulty occurs most often in those installations where the NaOCl injection pump does not run continuously. In such applications, the pump might run for as little as one (1) hour and then be allowed to sit idle for the next twenty-three (23) hours. If the piston is partially or fully withdrawn from its mating pump head during such idle time, the previously described NaOCl film will dry, resulting in hard, abrasive crystals forming on the piston surface. At this point, the piston surface can be likened to a nail file with a fine abrasive.

When the pump next begins to run, the piston having the newly formed abrasive surface will travel past the seal elements on its way into the pump head. This has been found to prematurely wear the seal elements such that they gradually lose the ability to perform their squeegee action on the piston. This in turn leads to an increase in crystallization during idle time and ultimate failure of the seal.

Once seals have been sufficiently worn, additional problems arise during idle time. NaOCl injection pumps of the type being addressed typically utilize a slight negative pressure of approximately 1-2 psig on the inlet port to preclude leakage of NaOCl out of the pump head during idle times. Pumps of the prior art typically include a pressure relief slot, also known as a "scavenger slot," to provide for such negative pressure. However, the combination of a worn seal with a pressure relief slot allows the negative pressure to aspirate air into the pump head. This air flow will gradually lead to evaporation of NaOCl liquid within the pump head such that crystallization will cause the piston to lock and be unmovable when the pump is later energized.

Design of the pump drive mechanism can be such as to assure full piston insertion into the pump head during idle time but such mechanisms add considerably to complexity, size and cost.

Therefore, it would be desirable to provide an effective solution to the crystallization problems described above, with minimum cost and without increasing size or complexity of the pump. More particularly, it would be desirable to provide a simply designed pump with provisions for reducing crystallization caused by evaporation of such chemicals as sodium hypochlorite, together with further provisions for minimizing leakage.

SUMMARY OF THE INVENTION

The pump of the present invention generally includes a pump housing and a pump piston. The pump housing defines a central longitudinal bore, a transverse bore communicating with the central bore for conveying a liquid through the pump housing, a liquid reservoir communicating with the central bore and the transverse bore for retaining an amount of the liquid conveyed through the transverse bore and a pressure relief slot extending from the transverse bore to the liquid reservoir. The pump piston is axially and rotatably slidable within the central longitudinal bore for pumping the liquid through the transverse bore.

In one embodiment, the pump housing includes an inner surface defining the central longitudinal bore, wherein the pressure relief slot is formed in the inner surface. In this embodiment, the pump housing preferably includes an inlet port and an outlet port, and the transverse bore includes an inlet portion extending between the inlet port and the central bore and an outlet portion extending between the central bore and the outlet port, wherein the pressure relief slot extends between the inlet portion of the transverse bore and the liquid reservoir.

In this same embodiment, the central bore preferably terminates at a longitudinal opening formed in the pump housing whereby the inner surface defining the central longitudinal bore is defined by a first longitudinal portion extending between the inlet portion of the transverse bore and the liquid reservoir and a second longitudinal portion extending between the liquid reservoir and the opening. The pressure relief slot is not formed in the second longitudinal portion of the inner surface, but, instead, the second longitudinal portion is preferably formed with a clearance between the central bore inner surface and the pump piston of about 0.00005 inches.

The pump housing may include a pump liner and a pump casing surrounding the pump liner, wherein the pump liner has the central bore, the transverse bore and the liquid reservoir formed therein, and wherein the transverse bore and the liquid reservoir open at an outer surface of the pump liner. In an alternative embodiment of the present invention, the pressure relief slot is formed in the outer surface of the liner and extends between the transverse bore and the liquid reservoir.

In this alternative embodiment, the pump casing also includes an inlet port and an outlet port, and the transverse bore of the pump liner includes an inlet portion extending between the inlet port and the central bore and an outlet portion extending between the central bore and the outlet port, wherein the pressure relief slot extends between the inlet portion of the transverse bore and the liquid reservoir.

The pump liner terminates at a longitudinal opening formed in the pump casing whereby the outer surface of the pump liner is defined by a first longitudinal portion extending between the inlet portion of the transverse bore and the liquid reservoir and a second longitudinal portion extending between the liquid reservoir and the pump casing opening, wherein the pressure relief slot is not formed in the second longitudinal portion of the outer surface.

In another alternative embodiment, a liquid pump of the present invention generally includes a pump housing and a pump piston, wherein the pump housing defines a central longitudinal bore, a transverse bore communicating with the central bore for conveying a liquid through the pump housing, and a pressure relief slot extending from the transverse bore. The piston is axially and rotatably slidable within the central longitudinal bore for pumping the liquid through the transverse bore and has at least one relief area formed in an outer surface thereof. The relief area forms a liquid reservoir communicating with the central bore, the transverse bore and the pressure relief slot for retaining an amount of the liquid conveyed through the transverse bore.

In this alternative embodiment, the relief area may comprise at least one annular groove formed in the outer surface of the pump piston. Also in this embodiment, the central bore terminates at a longitudinal opening formed in the pump housing whereby the central longitudinal bore is defined by a longitudinal portion having a length extending between the transverse bore and the opening, wherein the pressure relief slot preferably extends from the transverse bore and has a length less than the length of the longitudinal portion of the central longitudinal bore.

The present invention further involves a method for reducing leakage of a liquid pump. The method generally includes the steps creating a negative pressure at an inlet of a pump housing of the pump with a piston axially movable within a central bore of the pump housing, creating a positive pressure at an outlet of the pump housing with the piston and transferring fluid from a liquid reservoir formed in the pump housing to and from the inlet via a pressure relief slot extending between the inlet and the liquid reservoir.

The present invention further involves a method for preventing the formation of precipitates in a liquid chlorine solution pump. The method generally includes the steps of moving a piston within a bore of the pump to draw liquid chlorine solution into the pump, whereby the drawing of the liquid chlorine solution into the pump creates a negative pressure in an inlet of the pump, and moving the piston within the bore to force liquid chlorine solution out of the pump, whereby the forcing of the liquid chlorine solution out of the pump creates a positive pressure in an outlet of said pump. The method further includes the step of retaining an amount of the liquid chlorine solution in a liquid reservoir formed in the pump, wherein the liquid reservoir is in fluid communication with the pump bore, and the amount of the liquid chlorine solution retained in the reservoir is sufficient to prevent crystallization of the chlorine solution in the pump during an idle period of the pump. The method still further includes the step of inducing a flow of liquid chlorine solution between the liquid reservoir and the inlet via a pressure relief slot formed in the pump, wherein the negative and positive pressures induce the flow.

The preferred embodiments of the apparatus and method of the present invention, as well as other objects, features and advantages of this invention, will be apparent from the following detailed description, which is to be read in conjunction with the accompanying drawings.

DETAILED DESCRIPTION OF THE PREFERRED EMBODIMENTS

Figure 1:
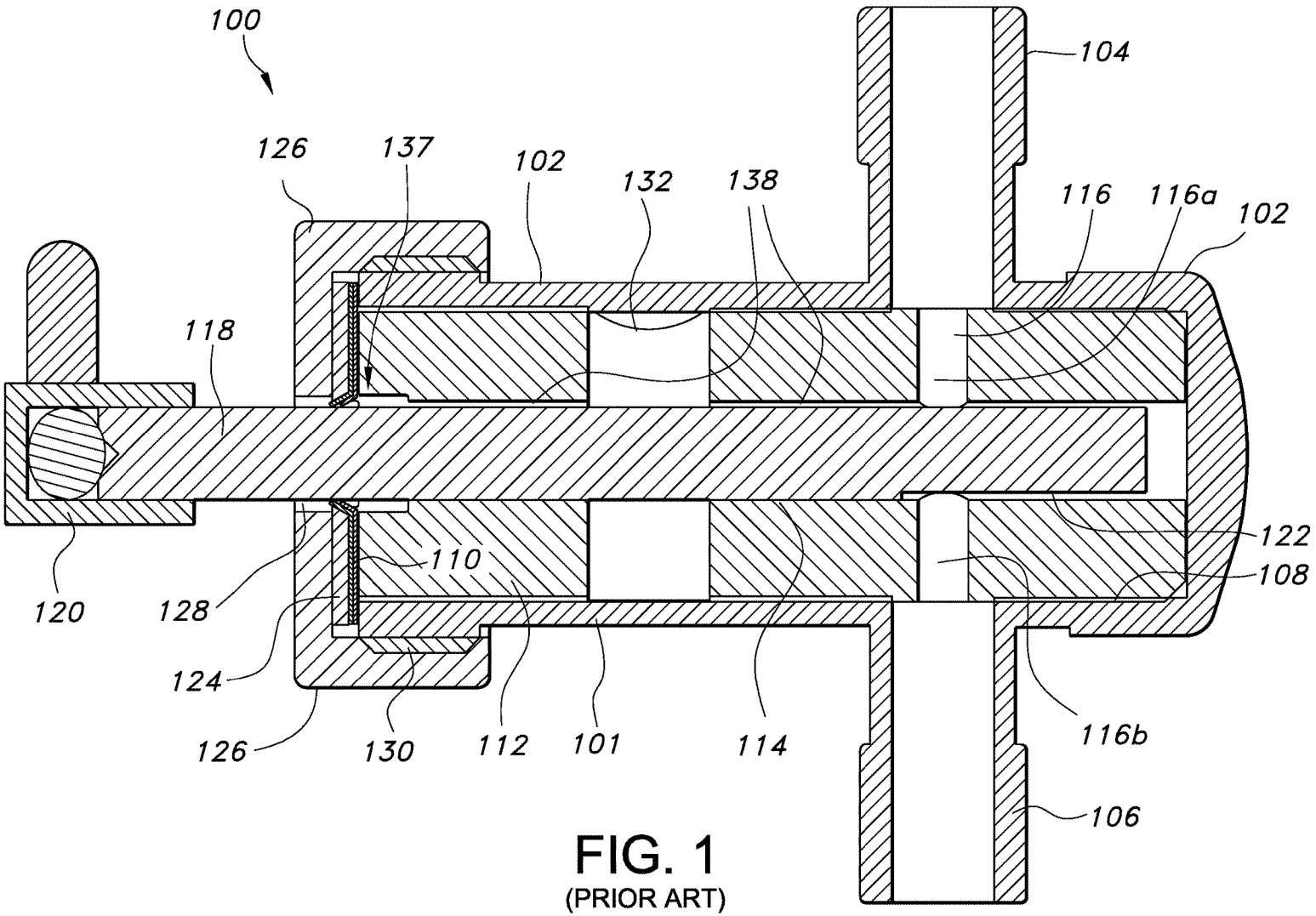
FIG. 1 (PRIOR ART)
FIG. 1 is a cross-sectional view of a liquid pump of the prior art.

Referring first to FIG. 1, a liquid pump 100 of the prior art is shown in cross-section. The pump 100 generally includes a pump housing 101 and a piston 118. The pump housing 101 preferably includes a plastic pump casing 102 having an inlet port 104 and an outlet port 106. The pump casing 102 defines a cylindrical chamber 108 having an open end 110. Received in the cylindrical chamber 108 is a ceramic piston liner 112 having a central longitudinal bore 114 and a transverse bore 116 communicating with the longitudinal bore. The transverse bore 116 includes an inlet portion 116*a* fluidly communicating with the inlet port 104 of the pump casing 102 and an outlet portion 116*b* fluidly communicating with the outlet port 106 of the pump casing so that a liquid, such as a chlorine solution, can be pumped from the inlet port, through the liner, to the outlet port in a manner as will be described below.

The pump 100 further includes a ceramic piston 118 axially and rotatably slidable within the central bore 114 of the piston liner 112. One end of the piston 118 extends out of the open end 110 of the pump casing 102 and includes a coupling 120 for engagement with a motor. At its opposite end, the piston 118 is formed with a relieved portion 122 disposed adjacent the transverse bore 116 of the pump liner. As will be described below, the relieved portion 122 is designed to direct fluid into and out of the pump 100.

A seal assembly 124 is provided at the open end 110 of the pump casing 102 to seal the piston 118 and the pump chamber 108. The seal assembly 124 is retained at the open end 110 of the pump casing 102 by a gland nut 126 having a central opening 128 to receive the piston 118. The gland nut 126 is preferably attached to the pump casing 102 with a threaded connection 130 provided therebetween.

In operation, a motor (not shown) drives the piston 118 to axially translate and rotate within the central bore 114 of the piston liner 112. In order to draw liquid into the transverse bore 116 from the inlet port 104, the piston 118 is rotated as required to align the relieved portion 122 with the inlet port. The piston 118 is then drawn back as required to take in the desired volume of liquid into the central bore 114 of the pump liner 112. Withdrawal of the piston 118 produces a negative pressure within the inlet portion 116*a* of the transverse bore 116, which draws in liquid from the inlet port 104. The piston 118 is then rotated to align the relieved portion 122 with the outlet port 106 of the pump casing 102. Finally, the piston 118 is driven forward the required distance to force liquid into the outlet port 106 via the outlet portion 116*b* of the transverse bore 116 to produce the desired discharge flow.

When pumping liquids with the pump shown in FIG. 1, some of the liquid will invariably seep into the space between the piston 118 and the piston liner 112. As mentioned above, one problem with pumping certain liquids, particularly NaOCl solutions, is the tendency for the liquid trapped between the piston 118 and the liner 112 to evaporate and crystallize during pump idle time. Such crystallization can build up on the piston 118 and eventually cause it to seize within the pump liner 112.

A solution to this crystallization problem is to form the pump liner 112 with a liquid reservoir 132 in communication with the central bore 114 of the liner. The liquid reservoir 132 allows a sufficient volume of liquid to be maintained around the pump piston 118 so as to prevent crystallization of the liquid. Specifically, by trapping a sufficient volume of liquid within the liquid reservoir 132, the surface to volume ratio of the liquid surrounding the piston 118 is decreased, thereby decreasing the tendency for the liquid to evaporate and crystallize. It has been found that at least approximately 0.7 cc of liquid volume is sufficient to prevent crystallization of the liquid.

To increase the fluid flow surrounding the piston 118 and thereby further decrease the chance for this liquid to evaporate, and to additionally provide a means for pressure at the seal assembly 124 to vent, the liner 112 is further preferably formed with a pressure relief slot 138 (also termed a "scavenger slot"). In prior art pumps, the pressure relief slot 138 communicates with and extends longitudinally along the central bore 114 of the liner 112 from the open end 110 of the liner to the inlet portion 116*a* of the transverse bore 116. The pressure relief slot 138 thus formed facilitates fluid flow back to the inlet portion 116*a* of the transverse bore 116 due to the negative pressure created at the inlet portion by movement of the piston 118. In other words, the negative pressure created at the inlet portion 116*a* of the transverse bore 116 tends to draw the liquid surrounding the piston 118 back to the inlet portion via the pressure relief slot 138. Also, since the outlet portion 116*b* of the transverse bore continuously sees a positive pressure, even during pump idle times, any migration of trapped liquid toward the negative pressure inlet portion 116*a* will be replaced with fresh liquid thereby further inhibiting crystallization.

However, one problem with conventional pressure relief slots is that it provides a direct path to atmosphere if the seal fails. In other words, while the pressure relief slot provides a benefit in relieving pressure from the seal of the pump, when the seal eventually wears out, the pump loses prime and pulls in air past the seal through the pressure relief slot feature. This air eventually leads to the pump head drying out when the pump is in storage. As discussed above, this drying out presents the problem of locking/jamming up the ceramic piston inside the liner.

Figure 2:
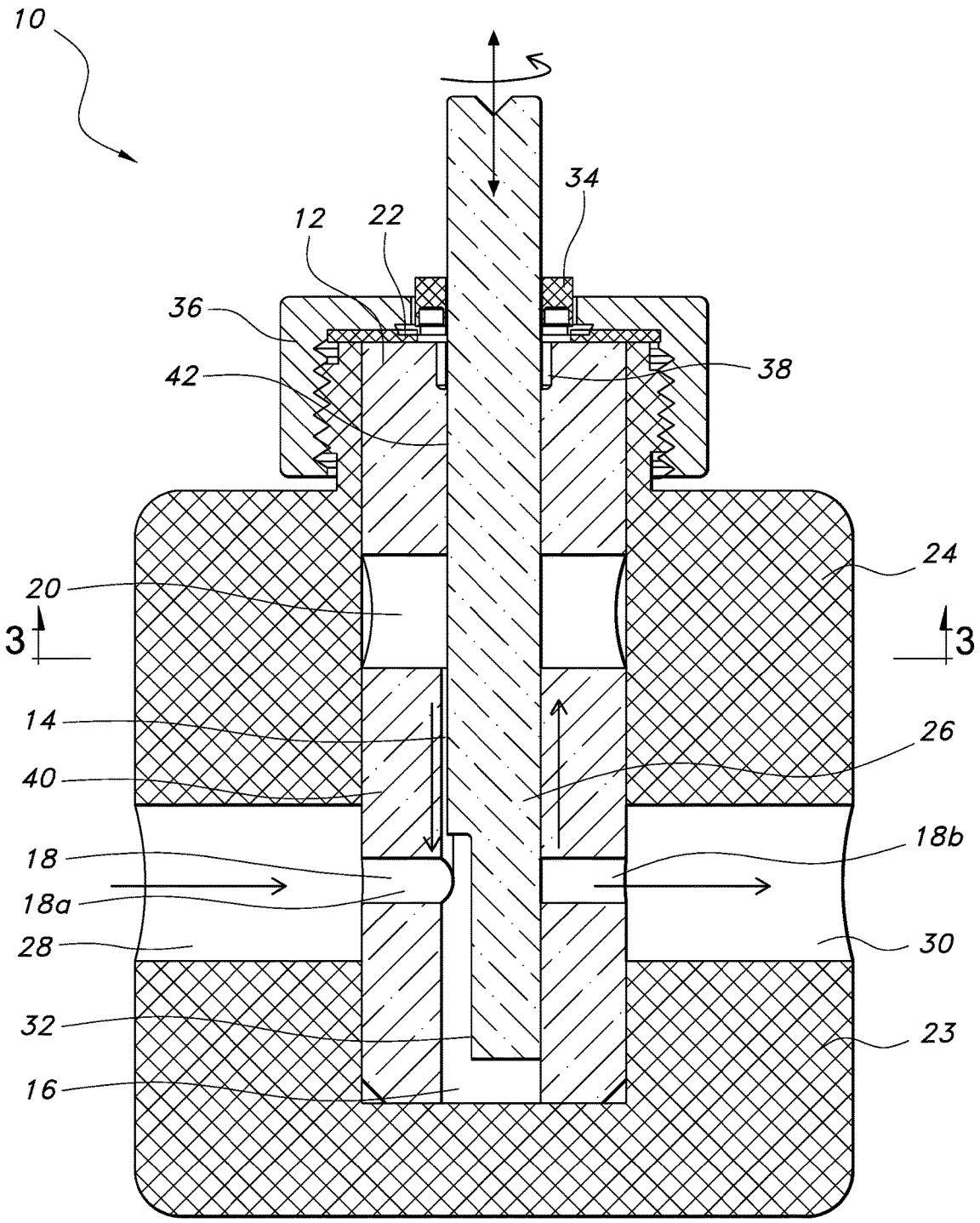
FIG. 2 is a cross-sectional view of the liquid pump formed in accordance with the present invention.

Turning now to FIG. 2, the pump 10 of the present invention solves this problem by providing a liner 12 having a pressure relief slot 14 that extends along the transverse bore 16 only from the negative pressure inlet portion 18*a* of the transverse bore 18 to the liquid reservoir 20. In other words, the pressure relief slot 14 of the present invention does not extend to the open end 22 of the liner 12, as it does in pumps of the prior art.

Like pumps of the prior art, the pump 10 of the present invention generally includes a pump housing 23 and a piston 26. The pump housing 23 includes a pump casing 24 having an inlet port 28, an outlet port 30 and defining a cylindrical chamber having an open end 22. Received in the cylindrical chamber is a ceramic piston liner 12 having a central longitudinal bore 16 and a transverse bore 18 communicating with the longitudinal bore. The transverse bore 18 includes an inlet portion 18*a* fluidly communicating with the inlet port 28 of the pump casing 24 and an outlet portion 18*b* fluidly communicating with the outlet port 30 of the pump casing so that a liquid, such as a chlorine solution, can be pumped from the inlet port, through the liner, to the outlet port in a manner as will be described below.

Like pumps of the prior art, the pump piston 26 is axially and rotatably slidable within the central bore 16 of the piston liner 12. One end of the piston 26 extends out of the open end 22 of the pump casing 24 and the opposite end is formed with a relieved portion 32 disposed adjacent the transverse bore 18 of the pump liner. As described above, the relieved portion 32 is designed to direct fluid into and out of the pump 10.

A seal assembly 34 is provided at the open end 22 of the pump casing 24 to seal the piston 26 and the pump chamber. The seal assembly 34 is retained at the open end 22 of the pump casing 24 by a gland nut 36 having a central opening to receive the piston 26. The gland nut 36 is preferably attached to the pump casing 24 with a threaded connection provided therebetween.

Operation of the pump 10 of the present invention is similar to that described above with respect to prior art pumps. Specifically, a motor drives the piston 26 to axially translate and rotate within the central bore 16 of the piston liner 12 to draw liquid into the transverse bore 18 from the inlet port 28 to the outlet port 30. The piston 26 is drawn back as required to take in the desired volume of liquid into the central bore 16 of the pump liner 12, thereby producing a negative pressure within the inlet portion 18*a* of the transverse bore 18, which draws in liquid from the inlet port 28. The piston 26 is then rotated to align the relieved portion 32 with the outlet port 30 of the pump casing and the piston is then driven forward the required distance to force liquid into the outlet port via the outlet portion 18*b* of the transverse bore 18 to produce the desired discharge flow.

Also, the pump liner 12 of the present invention is formed with a liquid reservoir 20 in communication with the central bore 16 of the liner. The liquid reservoir 20 allows a sufficient volume of liquid to be maintained around the pump piston 26 so as to prevent crystallization of the liquid.

Figure 3A:
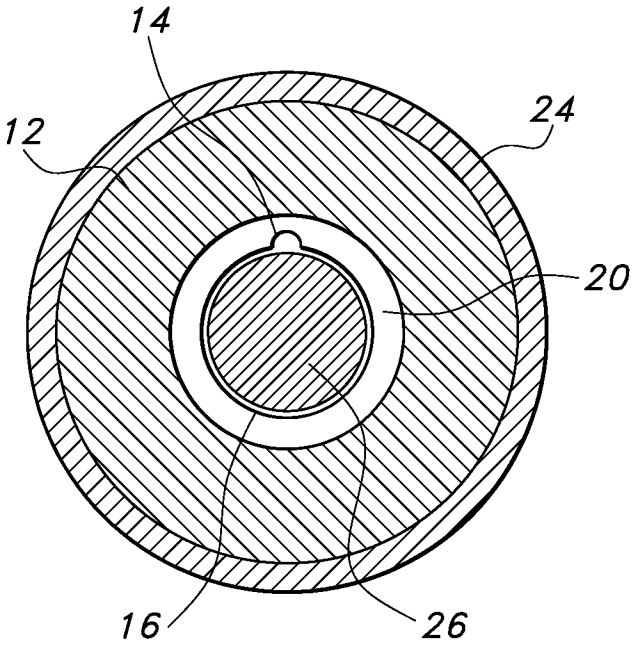
FIG. 3*a* is a cross-sectional view of an alternative embodiment of the pump shown in FIG. 2 taken along line 3-3.
Figure 3:
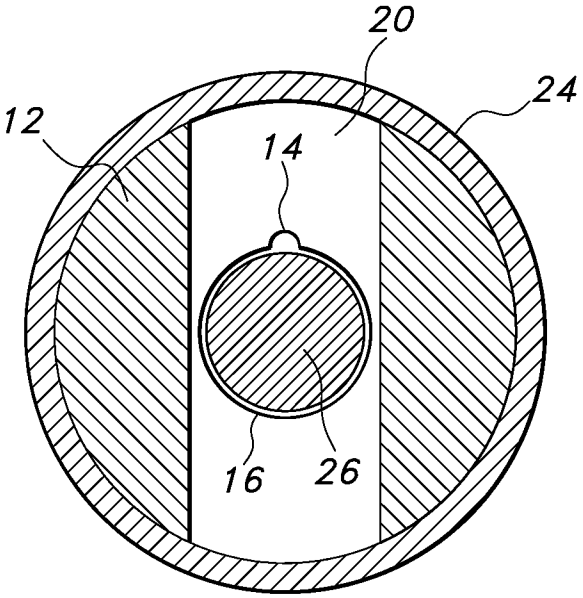
FIG. 3 is a cross-sectional view of the pump shown in FIG. 2 taken along line 3-3.

The liquid reservoir 20 can take the form of a transverse bore formed in the liner 12 and having a width greater than the diameter of the liner central bore, as shown in FIGS. 2 and 3. Alternatively, the liquid reservoir 20 can take the form of an annular counter-bore formed in the liner 12 surrounding the liner central bore 16, as shown in FIG. 3*a*. Also, a counter bore 38 may be provided in the liner 12 surrounding the central bore 16 at the open end 22 of the liner in addition to the liquid reservoir 20. The counter bore 38 provides an additional reservoir for storing lubricating liquid.

However, the pressure relief slot 14 of the present invention extends only from the inlet portion 18*a* of the transverse bore 18 to the liquid reservoir 20. This leaves a portion 40 of the liner 12 surrounding the central bore 16 between the inlet portion 18*a* and the reservoir 20 having the pressure relief slot 14 and another portion 42 of the liner surrounding the central bore between the reservoir 20 and the open end 22 without the slot. The portion 42 of the liner 12 without the slot can then be formed with a very tight diametric clearance with the piston 26. Such clearance is preferably on the order of between about 0.0001 and 0.00005 inches between the outside of the piston 26 and the inside of the liner 12. As a result of such tight clearance, no fluid can escape the liner in the portion 42 without the slot.

Figure 4:
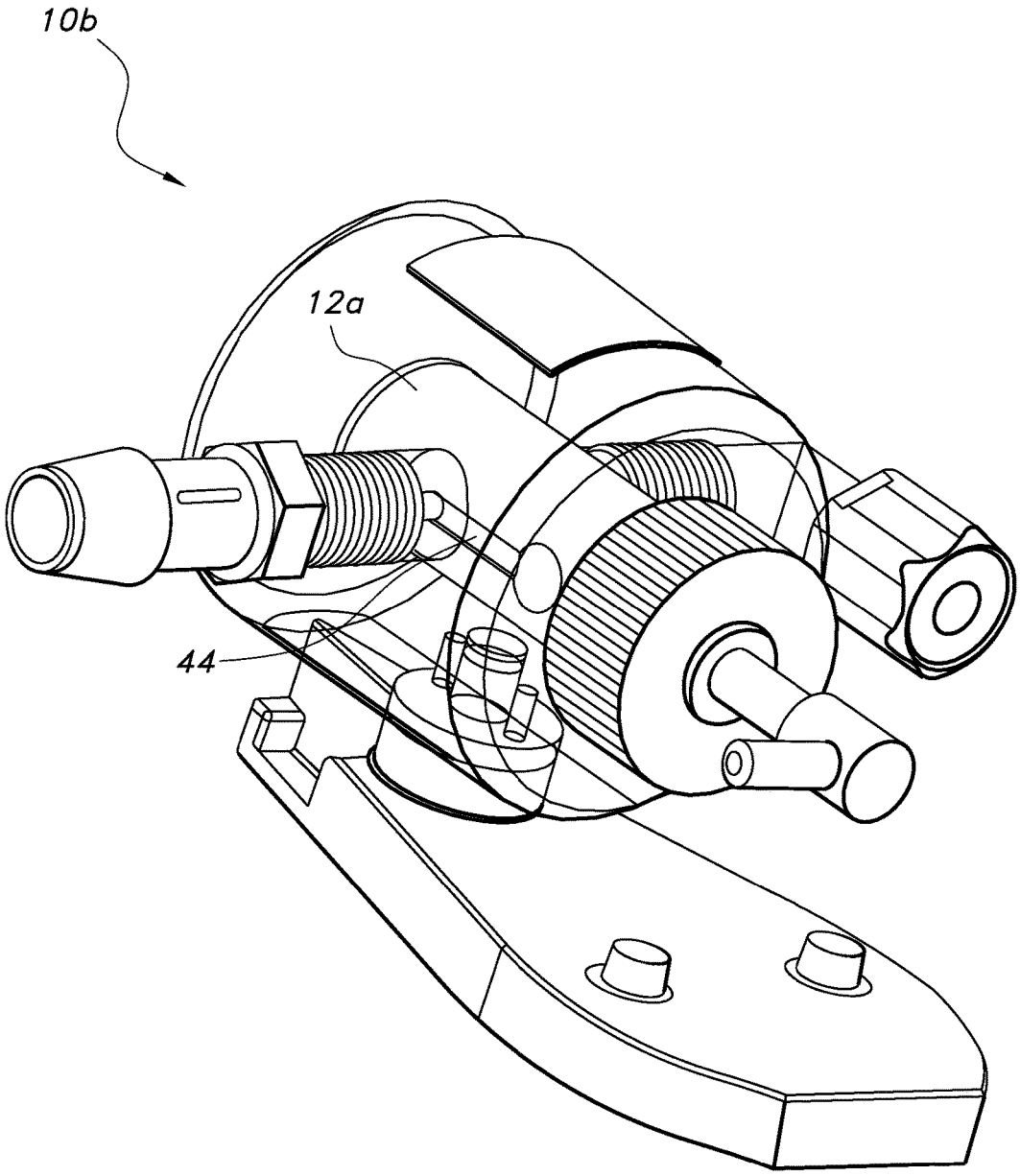
FIG. 4 is a top perspective view of an alternative embodiment of the pump of the present invention.
Figure 5:
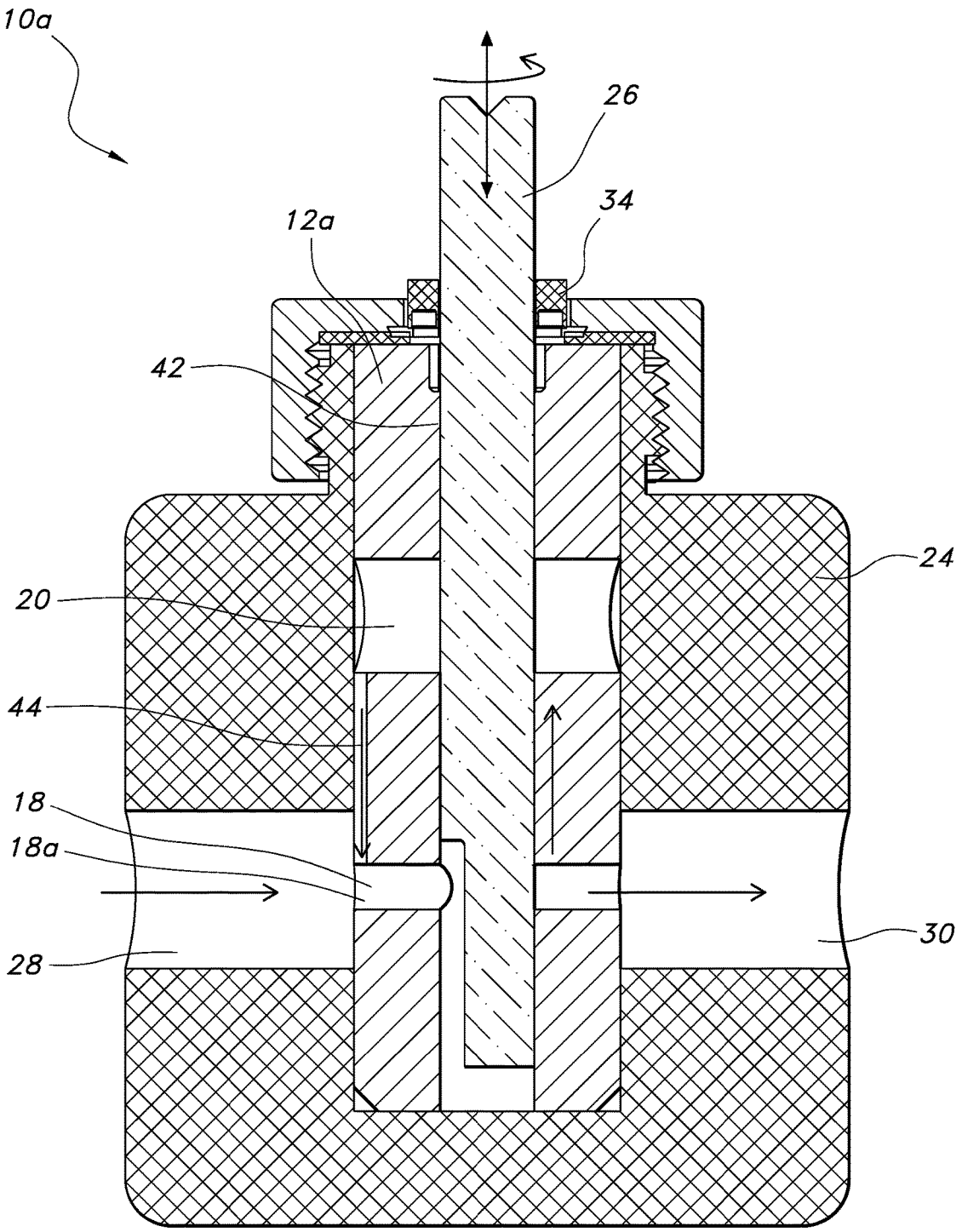
FIG. 5 is a cross-sectional view of the pump shown in FIG. 4.

In an alternative embodiment, as shown in FIGS. 4 and 5, a pressure relief slot 44 is formed on the outside surface of the liner 12*a* of a pump 10*a*, between the inlet portion 18*a* of the transverse bore 18 and the liquid reservoir 20. The slot 44 in this embodiment is enclosed by the pump casing 24 and, like the slot 14 described above, provides a pressure relief path between the high pressure outlet 30 and the low pressure inlet 28, without providing a detrimental path through which air can travel from the seal 34.

Figure 6:
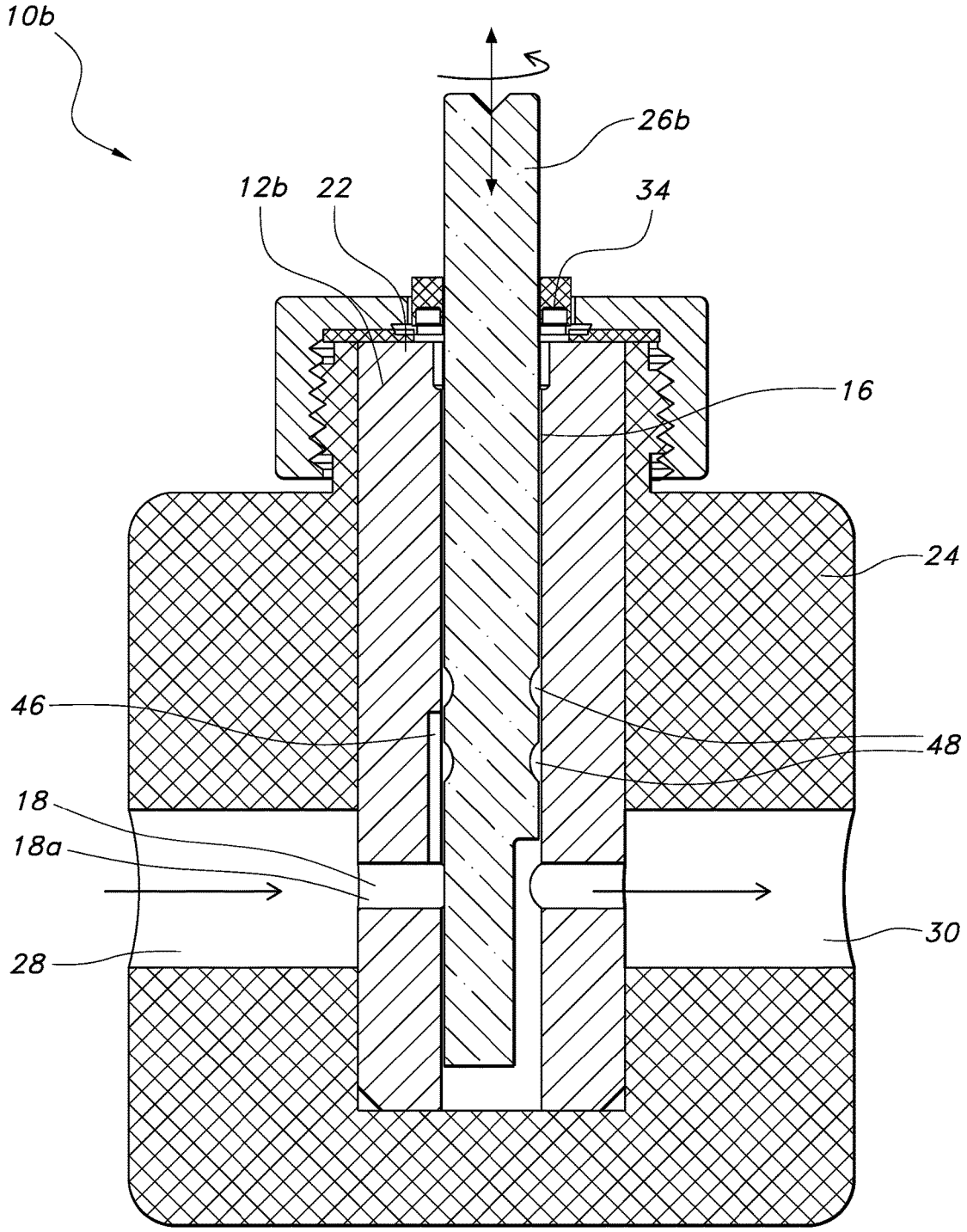
FIG. 6 is a cross-sectional view of another alternative embodiment of the pump of the present invention.

In another alternative embodiment, as shown in FIG. 6, a pressure relief slot 46 is formed on the inner surface of the central longitudinal bore 16, as described above with respect to FIG. 2. In this regard, the pressure relief slot 46 begins at the inlet portion 18*a* of the transverse bore 18 and extends towards the open end 22 of the pump casing 24, but terminates before reaching the open end. In this embodiment, a liquid reservoir is provided by the piston 26*b* in the form of one or more relief areas 48 formed on the outer radial surface of the piston 26*b*. These relief areas 48 preferably take the form of one or more annular grooves formed on the outer radial surface of the piston 26*b* for retaining an amount of the liquid conveyed through the transverse bore. In an exemplary embodiment, where the piston 26*b* has a diameter of 0.25 inches, the grooves may have a depth of about 0.01 inches and a width of about 0.1 inches.

The axial location of the relief areas 48 on the piston 26*b* and the length of the pressure relief slot 46 are chosen so as to ensure that at least one of the relief areas is in fluid communication with the pressure relief slot at all times during the stroke of the piston. Also, the relief areas 48 are positioned far enough away from the open end 22 of the ceramic liner 12*b* to prevent providing a detrimental path through which air can travel from the seal 34.

In all of the above described embodiments, high pressure liquid that builds up at the outlet 30 of the pump, caused by the forward action of the piston 26, can escape down the length of the piston to the liquid reservoir areas 20, 48 and back to the low pressure inlet 28 via the slot 14, 44, 46. Thus, the pressure relief slot 14, 44, 46 of the present invention accomplishes the same pressure relief function of prior art slots, without providing a large fluid path to atmosphere at the seal 34.

As a result, it is possible to prime and pump into high pressures without seals, (i.e., does not lose prime as easily without seals), because there is no direct port to the seal area or atmosphere. The present invention further minimizes fluid shock to the seal. Moreover, there is no catastrophic failure of the pump if the seals fail since the tight clearance between the piston and the pump liner at the portion of the pump liner without the seal will prevent any migration of fluid or air into or out of the pump.

Although preferred embodiments of the present invention have been described herein with reference to the accompanying drawings, it is to be understood that the invention is not limited to those precise embodiments and that various other changes and modifications may be affected herein by one skilled in the art without departing from the scope or spirit of the invention, and that it is intended to claim all such changes and modifications that fall within the scope of the invention.

What is claimed is:

1. A liquid pump comprising:

a pump casing having an inlet port and an outlet port;

a pump liner contained within said pump casing, said pump liner defining a central longitudinal bore, a transverse bore communicating with said central longitudinal bore for conveying a liquid through said pump casing, a liquid reservoir communicating with said central longitudinal bore and said transverse bore for retaining an amount of the liquid conveyed through said transverse bore and a pressure relief slot extending between said transverse bore and said liquid reservoir; and a pump piston axially and rotatably slidable within said central longitudinal bore of said pump liner for pumping the liquid through said transverse bore, wherein said transverse bore includes an inlet portion extending between said inlet port of said pump casing and said central longitudinal bore and an outlet portion extending between said central longitudinal bore and said outlet port of said pump casing, and wherein said central longitudinal bore of said pump liner terminates at a longitudinal opening formed in said pump casing whereby said central longitudinal bore of said pump liner is defined by a first longitudinal portion extending between said inlet portion of said transverse bore and said liquid reservoir and a second longitudinal portion extending between said liquid reservoir and said opening, and wherein said pressure relief slot is formed on an inner surface of said pump liner in said first longitudinal portion and extends only between said inlet portion of said transverse bore and said liquid reservoir, and wherein said pressure relief slot is not formed in said second longitudinal portion of said pump liner such that an inner surface of said liner in said second longitudinal portion is defined by a constant radius around a full circumference and along at least a substantial length of said second longitudinal portion, and wherein said inner surface of said liner in said second longitudinal portion is formed with a clearance of between about 0.0001 and 0.00005 inches with said pump piston.

2. A liquid pump comprising:

a pump casing having an inlet port and an outlet port;

a pump liner contained within said pump casing, said pump liner defining a central longitudinal bore, a transverse bore communicating with said central longitudinal bore for conveying a liquid through said pump casing, a liquid reservoir communicating with said central longitudinal bore and said transverse bore for retaining an amount of the liquid conveyed through said transverse bore and a pressure relief slot extending between said transverse bore and said liquid reservoir; and a pump piston axially and rotatably slidable within said central longitudinal bore of said pump liner for pumping the liquid through said transverse bore, wherein said transverse bore includes an inlet portion extending between said inlet port of said pump casing and said central longitudinal bore and an outlet portion extending between said central longitudinal bore and said outlet port of said pump casing, and wherein said pump liner terminates at a longitudinal opening formed in said pump casing whereby said pump liner is defined by a first longitudinal portion extending between said inlet portion of said transverse bore and said liquid reservoir and a second longitudinal portion extending between said liquid reservoir and said pump casing opening, and wherein said pressure relief slot is formed on an outer surface of said pump liner in said first longitudinal portion and extends only between said inlet portion of said transverse bore and said liquid reservoir, and wherein said pressure relief slot is not formed in said second longitudinal portion of said pump liner such that an outer surface of said liner in said second longitudinal portion is defined by a constant radius around a full circumference and along at least a substantial length of said second longitudinal portion.

3. A liquid pump as defined in claim 2, wherein said central longitudinal bore is formed with a clearance of between about 0.0001 and 0.00005 inches between an inner surface of said central longitudinal bore and an outer surface of said piston in said second longitudinal portion of said liner.

4. A liquid pump as defined in claim 1, wherein said liquid reservoir comprises a second transverse bore having a width greater than the diameter of said central longitudinal bore.

5. A liquid pump as defined in claim 1, wherein said liquid reservoir comprises an annular counter bore surrounding said central longitudinal bore.

6. A liquid pump comprising:

a pump housing defining a central longitudinal bore, a transverse bore communicating with said central longitudinal bore for conveying a liquid through said pump housing, and a pressure relief slot extending from said transverse bore; and a pump piston axially and rotatably slidable within said central longitudinal bore for pumping the liquid through said transverse bore, said pump piston having an annular groove formed in an outer surface thereof, said annular groove forming a liquid reservoir communicating with said central longitudinal bore, said transverse bore and said pressure relief slot for retaining an amount of the liquid conveyed through said transverse bore.

7. A liquid pump as defined in claim 6, wherein said central longitudinal bore terminates at a longitudinal opening formed in said pump housing whereby said central longitudinal bore is defined by a longitudinal portion having a length extending between said transverse bore and said opening, and wherein said pressure relief slot extends from said transverse bore and has a length less than said length of said longitudinal portion of said central longitudinal bore.

* * * * *